US008508425B2

(12) United States Patent
Aizawa

(10) Patent No.: US 8,508,425 B2
(45) Date of Patent: Aug. 13, 2013

(54) PATCH ANTENNA, ANTENNA UNIT AND ANTENNA APPARATUS

(75) Inventor: Toshiaki Aizawa, Tokyo (JP)

(73) Assignee: Mitsumi Electric, Co., Ltd., Tokyo (JP)

( * ) Notice: Subject to any disclaimer, the term of this patent is extended or adjusted under 35 U.S.C. 154(b) by 321 days.

(21) Appl. No.: 13/075,328

(22) Filed: Mar. 30, 2011

(65) Prior Publication Data

US 2011/0241961 A1 Oct. 6, 2011

(30) Foreign Application Priority Data

Mar. 31, 2010 (JP) ..... 2010-080177

(51) Int. Cl.
*H01Q 19/06* (2006.01)

(52) U.S. Cl.
USPC ..... 343/833; 343/700

(58) Field of Classification Search
USPC ..... 343/833, 834, 841, 867, 872, 700, 343/702, 711, 712, 713, 715, 725, 727, 728, 343/729, 742; 455/344, 374
See application file for complete search history.

(56) References Cited

U.S. PATENT DOCUMENTS 7,042,399 B2 * 5/2006 Noro et al. ..... 343/700 MS
2012/0242533 A1 * 9/2012 Shiba ..... 342/146

FOREIGN PATENT DOCUMENTS

JP 2006-237813 A 9/2006

* cited by examiner

*Primary Examiner* — Karl D Frech
(74) *Attorney, Agent, or Firm* — Washida & Associates

(57) ABSTRACT

Provided is a patch antenna, an antenna unit and an antenna apparatus that can increase the directional gain of a patch antenna at a high angle of elevation and that can make the directional gain of a patch antenna at a given angle of elevation uniform at all azimuth angles. Patch antenna 11 has patch antenna main body 40 having antenna electrode 43 on its top surface, and a waveguide 60 mounted on the top surface of patch antenna main body 40. Waveguide 60 has top plate 62 having a larger flat surface than patch antenna main body 40 and having L-shaped slot 621 on the flat surface, and spacer 61 provided between the top surface of patch antenna main body 40 and top plate 62 and separating antenna electrode 43 and top plate 62 a predetermined distance apart.

3 Claims, 5 Drawing Sheets

PATCH ANTENNA, ANTENNA UNIT AND ANTENNA APPARATUS

CROSS REFERENCE TO RELATED APPLICATIONS

This application is entitled to and claims the benefit of Japanese Patent Application No. 2010-080177, filed on Mar. 31, 2010, the disclosure of which including the specification, drawings and abstract, is incorporated herein by reference in its entirety.

TECHNICAL FIELD

The present invention relates to a patch antenna, an antenna unit having that patch antenna, and an antenna apparatus having that antenna unit.

BACKGROUND ART

A digital radio receiver to receive a satellite wave or ground wave so as to listen to digital radio broadcast has been developed and put in practical use in the United States of America. A digital radio receiver of this kind is generally mounted on a mobile object such as an automobile, and is designed to receive a radio wave having a frequency of about 2.3 GHz to listen to radio broadcast. For example, a Sirius satellite radio antenna apparatus normally serves to receive circular polarized radio waves from three orbiting satellites (synchronous type) and, in an insensitive zone, receive a radio wave from a ground linear polarization facility.

A digital radio receiver has an antenna apparatus for receiving a radio wave. This antenna apparatus is attached outside a mobile object. Also, this antenna apparatus is comprised of an antenna unit and an antenna case for covering this antenna unit. The antenna case is comprised of a dome-shaped top cover and a bottom plate. The antenna unit is comprised of an antenna element, a circuit board and a shield case. The antenna element comprised of, for example, a ceramic patch antenna, and receives a radio wave. The circuit board is provided with a signal processing circuit for performing various kinds of signal processing such as signal amplification upon a signal received by the antenna element. The shield case serves to shield the signal processing circuit from outside electric field and outside magnetic field.

The patch antenna is provided with an antenna electrode, an earthing conductor, a ceramic antenna board placed between the antenna electrode and the earthing conductor, and a feed pin that is electrically connected with the antenna electrode. A patch antenna that provides a top plate having a rectangular hole as a waveguide path on this antenna electrode is known (see, for example, patent literature 1). By providing a top plate having a rectangular hole, it is possible to increase the directional gain of the patch antenna at a high angle of elevation.

PATENT LITERATURE

PTL 1: Japanese Patent Application Laid-Open No. 2006-237813

SUMMARY OF INVENTION

However, a conventional patch antenna having a waveguide needs to make the directional gain at a given elevation angle uniform at all azimuth angles.

It is therefore an object of the present invention to provide a patch antenna, an antenna unit and an antenna apparatus that can increase the directional gain of a patch antenna at a high angle of elevation, and that can make the directional gain at a given elevation angle uniform at all azimuth angles.

In order to achieve the above object, a patch antenna according to the present invention has: a patch antenna main body having an antenna electrode on a top surface thereof; and a waveguide mounted on the top surface of the patch antenna main body, and, in this patch antenna, the waveguide has: a top plate having a flat surface larger than the patch antenna main body and having an L-shaped slit on the flat surface: and a spacer being provided between the top surface of the patch antenna main body and the top plate and separating the antenna electrode and the top plate a predetermined distance apart.

An antenna unit according to the present invention has: the above patch antenna; a circuit board on which a signal processing circuit for processing a signal received by the patch antenna is formed; and a shield case that shields the signal processing circuit.

An antenna apparatus according to the present invention has: the above antenna unit; a bottom plate; and a unit fixing member that is provided between the antenna unit and the bottom plate and that fixes the antenna unit on the bottom plate.

With the present invention, it is possible to increase the directional gain of a patch antenna at a high angle of elevation and make the directional gain uniform at all azimuth angles on a horizontal plane.

DESCRIPTION OF EMBODIMENTS

Now, an embodiment of the present invention will be described in detail with reference to the accompanying drawings. The scope of the present invention is not limited to the illustrated examples.

Figure 1:
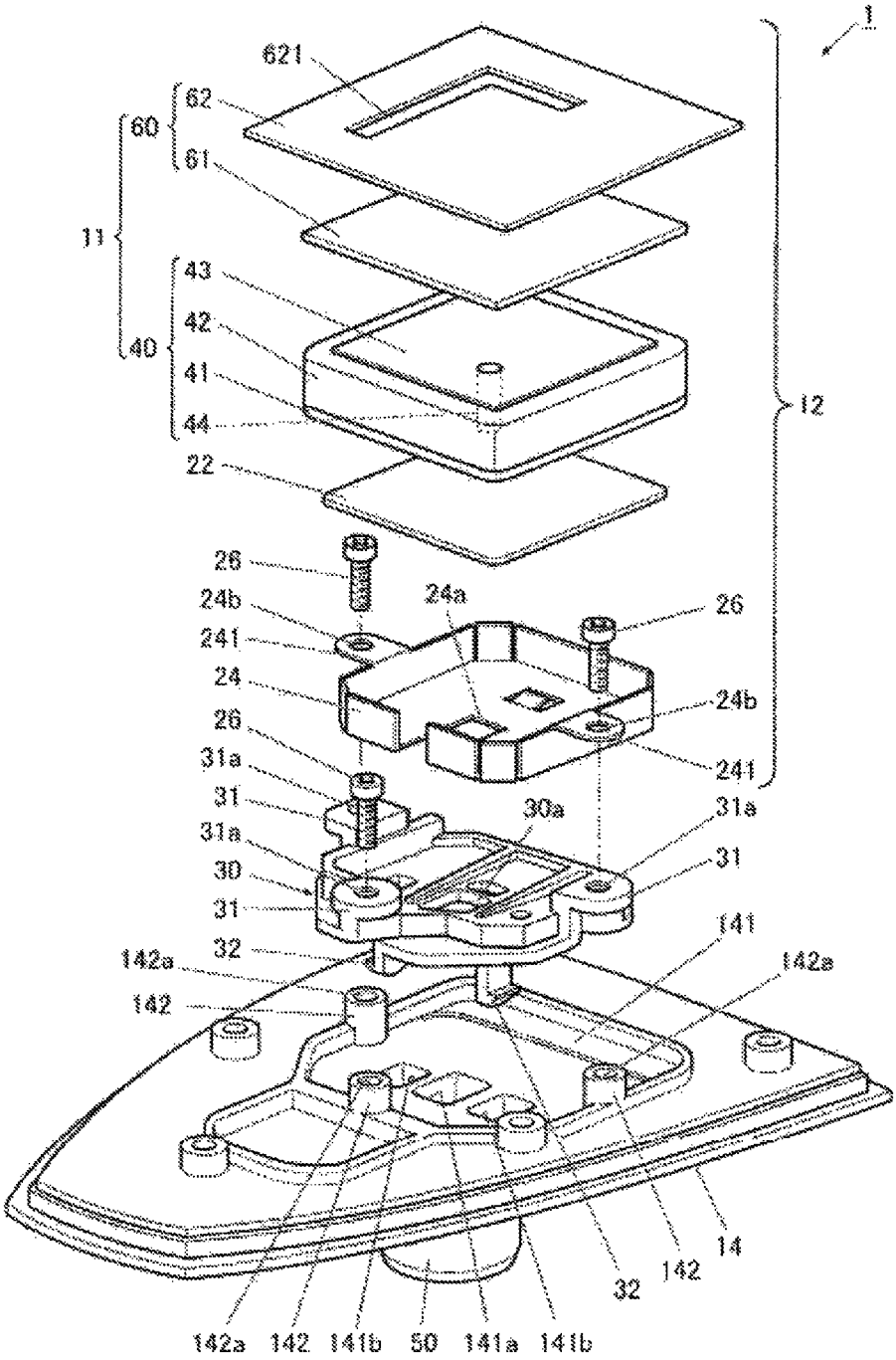
FIG. 1 is an exploded perspective view of an antenna apparatus according to an embodiment of the present invention.

Antenna apparatus 1 including patch antenna 11 of the present embodiment will be described with reference to FIG. 1. FIG. 1 shows an exploded configuration of antenna apparatus 1. Antenna apparatus 1 shown in FIG. 1 is an antenna apparatus for a satellite digital radio receiver and is provided on a roof of a mobile object such as an automobile.

Antenna apparatus 1 is comprised of antenna unit 12 and an antenna case for covering this antenna unit 12. This antenna case is comprised of a dome-shaped top cover (not shown) and bottom plate 14. Antenna unit 12 is accommodated in the top cover.

Antenna unit 12 has patch antenna 11, circuit board 22 and shield case 24. Patch antenna 11 receives a received satellite wave and outputs a received signal. Circuit board 22 is provided with a circuit (hereinafter "signal processing circuit") for performing various kinds of signal processing such as signal amplification upon the signal output from patch antenna 11. Patch antenna 11 and circuit board 22 are jointed by means of, for example, a double-side adhesive tape (not shown).

A cable for extracting a reception signal to the outside of the antenna case is connected to circuit board 22 (not shown). Then, on circuit board 22, on the principal surface opposite to the surface where patch antenna 11 is provided, shield case 24 for shielding the signal processing circuit is mounted.

Shield case 24 has opening 24*a* for allowing a cable connected to circuit board 22 to pass therethrough. Shield case 24 has a pair of tabs 241 that extend outward from its opposing side surfaces.

These tabs 241 each have through-hole 24*b* for allowing screw 26 to penetrate.

Antenna apparatus 1 has unit fixing member 30 that is provided between antenna unit 12 and bottom plate 14. This unit fixing member 30 serves to provisionally fix antenna apparatus 1 on the roof of a mobile object (car body) and fix antenna unit 12 on bottom plate 14. That is to say, unit fixing member 30 is provided directly below antenna unit 12.

On the other hand, bottom plate 14 has recess 141 for accommodating this unit fixing member 30. Bottom plate 14 has three bosses 142 having three screw holes 142*a* to be screwed or engaged with three screws 26. Two of these three bosses 142 are provided in positions corresponding to the pair of tabs 241 of shield case 24.

Unit fixing member 30 has three boss receiving parts 31 in positions corresponding to three bosses 142 of bottom plate 14 and adapted to receive the bosses. These boss receiving section 31 are provided with communication holes 31*a* for allowing three screws 26 to communicate. Unit fixing member 30 has hole 30*a* for allowing the cable connected to circuit board 22 to pass therethrough. Furthermore, unit fixing member 30 has a pair of claws 32 that extend downward to provisionally fix antenna apparatus 1 on the roof of a mobile object (car body).

Bottom plate 14 has 141*a* for allowing a cable to pass through recess 141, and two holes 141*b* for allowing a pair of claws 32 to pass.

The method of fixing the method of fixing antenna apparatus 1 of the above configuration to a mobile object (car body) will be described with reference to FIG. 1.

First, a pair of claws 32 of unit fixing member 30 are made to pass through two holes 141*b* of bottom plate 14. On the other hand, three bosses 142 of bottom plate 14 are received in a state these bosses are inserted in boss receiving parts 31 of unit fixing member 30.

Next, three screws 26 are screwed in or engaged with screw holes 142*a* of bosses 142 through two holes 24*b* of shield case 24 and three communication holes 31*a* of unit fixing member 30. By this means, antenna unit 12 is fixed on bottom plate 114 through unit fixing member 30.

Next, cylindrical bolt 50 that extends downward from the lower surface of bottom plate 14 is inserted in an opening (not shown) formed on the roof (not shown) of a mobile object (car body). By this means, antenna apparatus 1 is provisionally fixed on the roof of a mobile object (car body).

Then, a nut (not shown) is engaged with bolt 50, so that antenna apparatus 1 is permanently fixed on the roof of a mobile object (car body).

With the present embodiment, antenna apparatus 1 is provisionally fixed on a mobile object (car body) and unit fixing member 30 for fixing patch antenna 11 on bottom plate 14 is provided directly below antenna unit 12 so that unit fixing member 30 and patch antenna 11 overlap. As a result of this, it is possible to reduce the space required inside the antenna case. It is therefore possible to provide antenna apparatus 1 that is smaller in size and that is excellent ion designability.

Patch antenna 11 has waveguide 60 and patch antenna main body 40. Patch antenna main body 40 has earthing conductor 41, base 42, antenna electrode 43 and feed pin 44. Earthing conductor 41 is a metal conductor part formed on the bottom surface of base 42. Base 42 is a ceramic, dielectric base plate. Base 42 may be a magnetic material or magnetic dielectric. Base 42 has, for example, a cuboid shape having R-shaped surfaces. Antenna electrode 43 is a metal conductor part that is formed in the top plate of base 42 and that is earthed. Earthing conductor 41 and antenna electrode 43 are formed by, for example, screen printing on the bottom surface and top surface of base 42.

Feed pin 44 is provided to penetrate through earthing conductor 41 and base 42, and is electrically connected with antenna electrode 43. Feed pin 44 is connected with a feed part of circuit board 22. Earthing conductor 41 is connected with the ground part of circuit board 22.

Waveguide 60 is mounted on the top surface of patch antenna main body 40. Waveguide 60 has spacer 61 and top plate 62. Spacer 61 is comprised of a foam cushion member or the like. Spacer 61 is formed with, for example, a polyurethane foam, but is preferably formed with a material having a low permissivity. Spacer 61 is plastered on the top surface of antenna electrode 43, and separates antenna electrode 43 and top plate 43 a predetermined distance apart.

Top plate 62 is a square, rectangular flat plate that is mounted on the top surface of spacer 61. Top plate 62 is a metal plate of aluminum, copper or iron. Top plate 62 may be formed with a metal tape as well. Top plate 62 has L-shaped, belt-like slit 621, which is a slit having the shape of the letter L.

Figure 2:
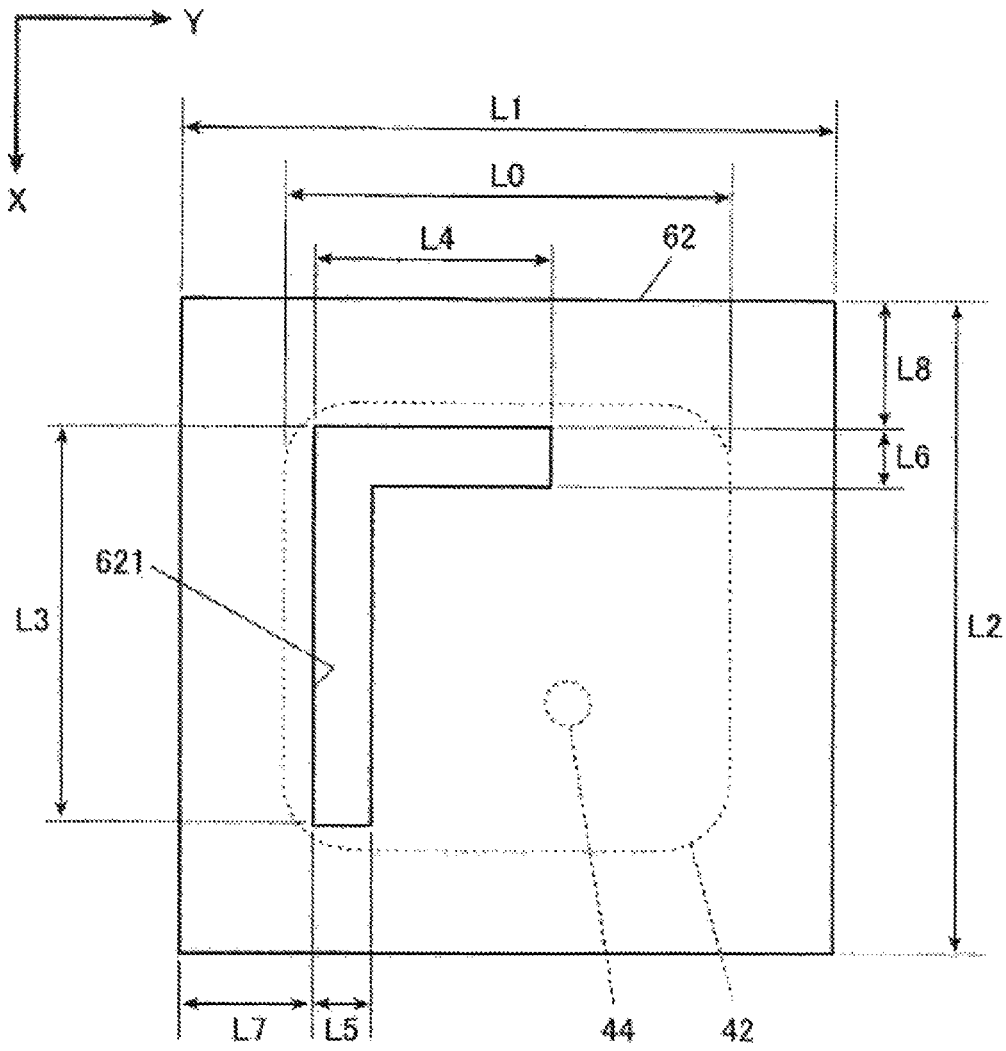
FIG. 2 is a plan view showing the dimensions and arrangement of a top plate.

Next, the dimensions and arrangement of top plate 62 will be described by way of example with reference to FIG. 2. FIG. 2 shows the dimensions and arrangement of top plate 62. As shown in FIG. 2, there are an X axis and a Y axis. Top plate 62 is arranged such that its top surface is arranged above square patch antenna main body 40 via spacer 61. L-shaped slit 621 of top plate 62 is preferably arranged in a position in a diagonal direction to feed pin 44 on a surface of top plate 62.

The length of top plate 62 in the Y axis direction is L1 and likewise the length in the X axis direction is L2. The length of the belt-like part of L-shaped slit 621 in the long direction is L3, and likewise the length in the short direction is L4. Furthermore, the width of the belt-like part of L-shaped slit 621 in the long direction is L5, and likewise the width in the short direction is L6. Also, the length from the left end of top plate 62 to L-shaped slit 621 in the Y-axis direction is L7, and the length from the upper end of top plate 62 to L-shaped slit 621 in the X-axis direction is L8. Also, the length of one side of a surface of patch antenna main body 40 (base 42) is L0.

Lengths L1 and L2 hold: L1, L2>L0. Top plate 62 is formed on a flat plane in a size and arrangement to conceal patch antenna main body 40. Lengths L3 and L4 hold: L3, L4<L0. L-shaped slit 621 is preferably provided on a surface inside patch antenna main body 40. Furthermore, although lengths L3 and L4 should preferably hold L3>L4, L3=L4 is also possible.

An example of the dimensions and arrangement of top plate 62 are shown. With patch antenna main body 40 (base 42), LO=23 [mm]. Furthermore, with top plate 62, L1=L2=31 [mm]. L3=20 [mm] and L4=12 [mm]. L5=L6=3 [mm]. Also, L7=L8=7 [mm]. The distance between antenna electrode 43 and top plate 62 (that is, the thickness of spacer 61) is 2 [mm].

Figure 3:
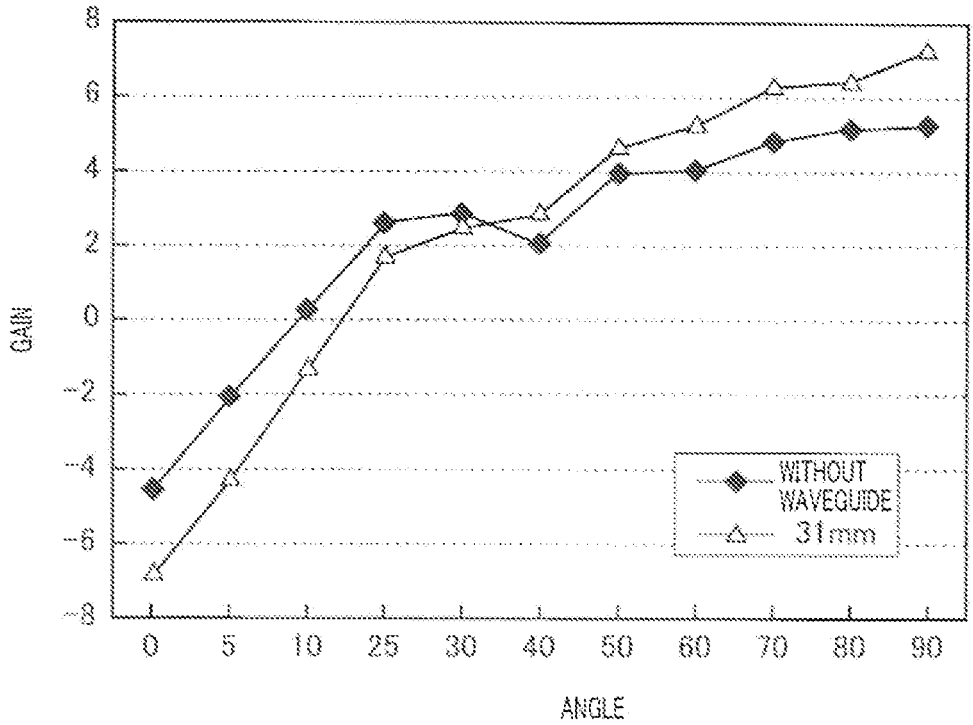
FIG. 3 shows the antenna gains of a patch antenna without a waveguide and a patch antenna according to an embodiment at elevation angles.
Figure 4A:
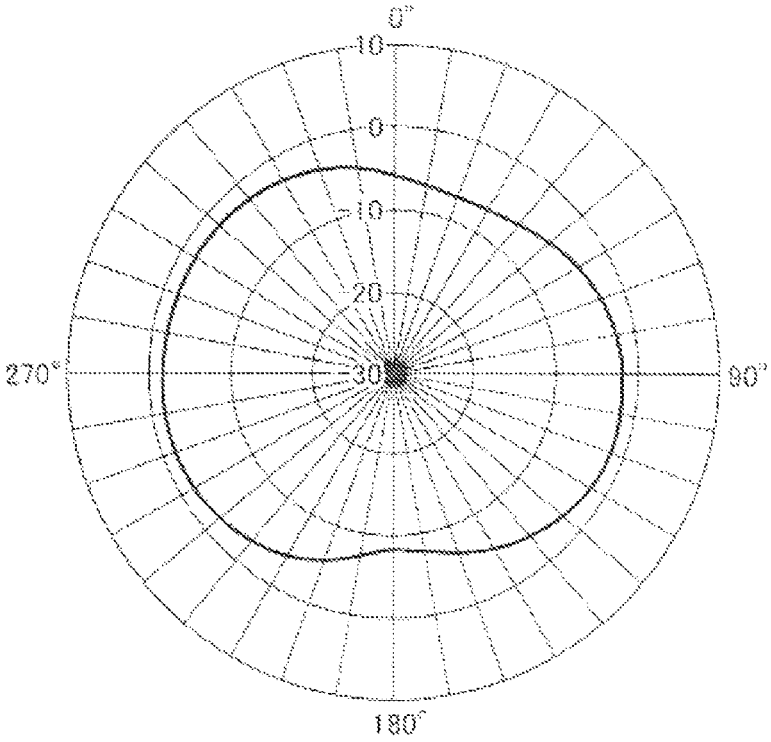
FIG. 4A shows a directional gain of a patch antenna having a waveguide without an L-shaped slit.
Figure 4B:
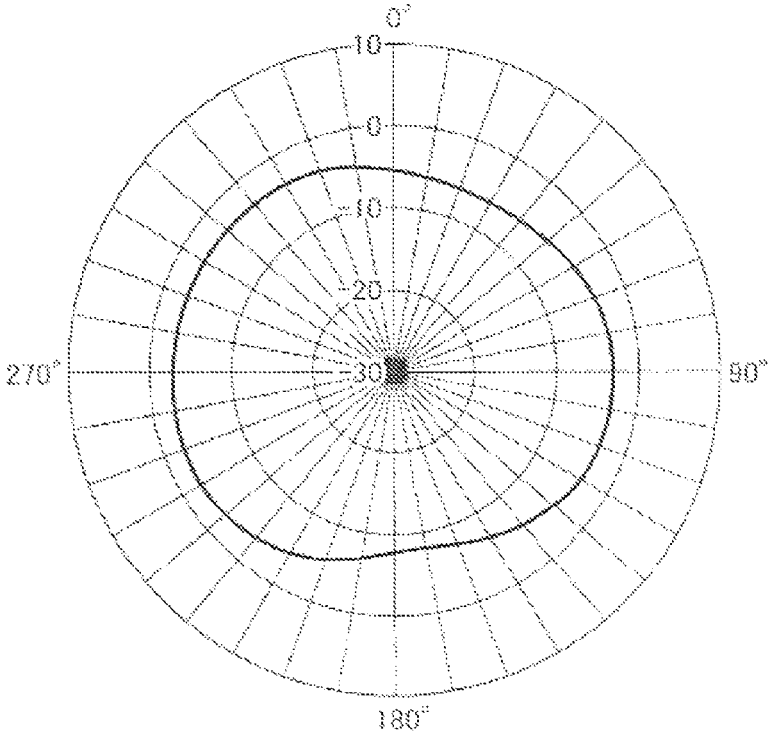
FIG. 4B shows a directional gain of a patch antenna according to the present embodiment.
Figure 5:
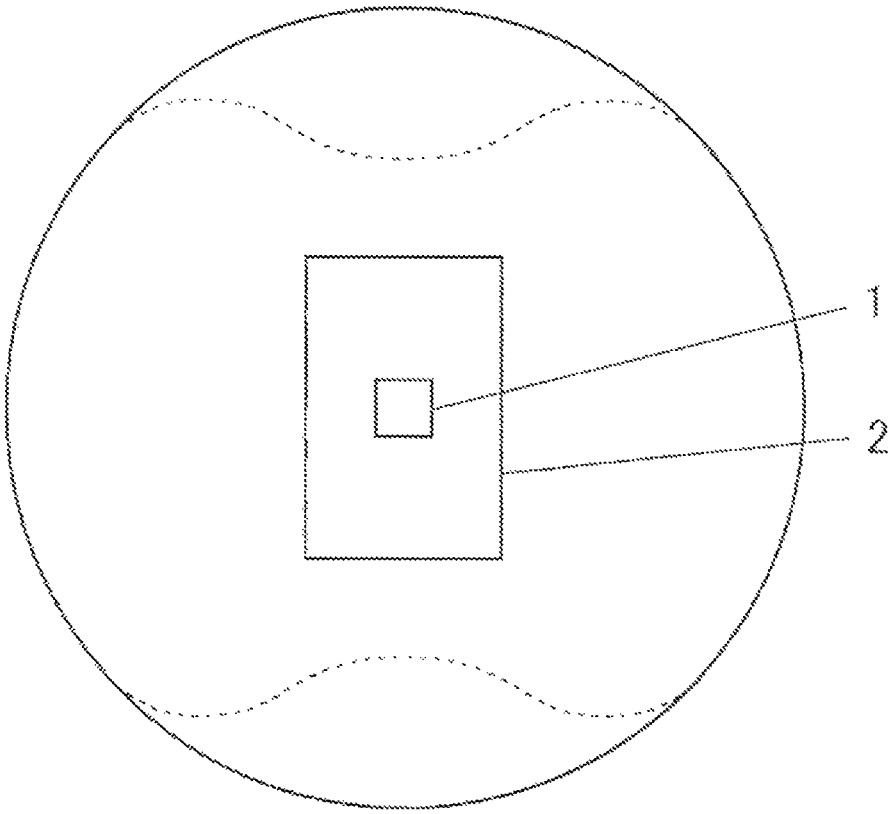
FIG. 5 shows schematically a directional gain of an antenna apparatus mounted on a car body.

Next, antenna characteristics of patch antenna 11 will be described with reference to FIG. 3-FIG. 5. FIG. 3 shows antenna gains of a patch antenna without waveguide 60 (patch antenna main body 40), and patch antenna 11 at a high angle of elevation. FIG. 4A shows the directional gain of a patch antenna having a waveguide without an L-shaped slit. FIG. 4B shows the directional gain of patch antenna 11. FIG. 5 schematically shows the directional gain of an antenna apparatus mounted on car body 2.

As shown in FIG. 3, a simulation has been conducted for the antenna gain of patch antenna 11 of the above dimensions and arrangement of an example, at with respect to angle of elevation. Also, with such patch antenna 11 of the above dimensions and arrangement of an example, a simulation has been conducted for the antenna gain of a patch antenna without waveguide 60 (patch antenna main body 40). Also, table 1 below shows the values in the graph of FIG. 3.

TABLE 1

| | Gain [dBi] | |
|---|---|---|
| Angle [°] | Without top plate | With top plate (31 mm) |
| 0 | −4.55 | −6.74 |
| 5 | −2.05 | −4.24 |
| 10 | 0.29 | −1.24 |
| 25 | 2.62 | 1.76 |
| 30 | 2.88 | 2.60 |
| 40 | 2.13 | 2.92 |
| 50 | 4.02 | 4.69 |
| 60 | 4.06 | 5.32 |
| 70 | 4.90 | 6.37 |
| 80 | 5.19 | 6.45 |
| 90 | 5.27 | 7.34 |

Patch antenna 11 and patch antenna main body 40 both have greater gains as the angle of elevation increases. Furthermore, with patch antenna 11, the slope of the increase of antenna gain accompanying the increase of the angle of elevation is steeper than with patch antenna main body 40. Consequently, by means of waveguide 60, patch antenna 11 achieves a high gain at a high angle of elevation.

As shown in FIG. 4A, a simulation has been performed for the directional gain of a patch antenna of the above dimensions and arrangement of an example, without L-shaped slit 621 on top plate 62, at a low elevation angle (5°) at all azimuth angles. An average gain value of a patch antenna having a waveguide without L-shaped slit 621 at an elevation angle of 5° at all azimuth angles, the maximum gain value, the minim gain value, and the value given by subtracting the minim gain value from the maximum gain value, are shown in next table 2.

TABLE 2

| Without L-shaped slit [dBi] | |
|---|---|
| Average gain value [dBi] | −3.31 |
| Maximum gain value [dBi] | −1.29 |
| Minimum gain value [dBi] | −8.37 |
| Maximum gain value − minimum gain value [dBi] | 7.08 |

Furthermore, as shown in FIG. 4B, a simulation is conducted for the directional gain of patch antenna 11 at all azimuth angles at a low elevation angle (5°). An average gain value of patch antenna 11 at all azimuth angles at an elevation angle of 5°, the maximum gain value, the minim gain value and the value given by subtracting the minim gain value from the maximum gain value, are shown in next table 3.

TABLE 3

| With L-shaped slit [dBi] | |
|---|---|
| Average gain value [dBi] | −4.24 |
| Maximum gain value [dBi] | −2.48 |
| Minimum gain value [dBi] | −8.26 |
| Maximum gain value − minimum gain value [dBi] | 5.78 |

Thus, patch antenna 11 has a lower average gain value at a low elevation angle at all azimuth angles, than a patch antenna having a waveguide without L-shaped slit 621. By this means, patch antenna 11 has a greater antenna gain at a high elevation angle than a patch antenna having a waveguide without L-shaped slit 621.

Also, with patch antenna 11, the value of subtracting the minimum gain value from the maximum gain value of all azimuth angles is smaller than with a patch antenna having a waveguide without L-shaped slit 621. Consequently, patch antenna 11 achieves uniform gain, regardless of the azimuth angle, compared to a patch antenna having a waveguide without L-shaped slit 621.

FIG. 5 schematically shows the antenna characteristics of FIG. 4A and FIG. 4B. As shown in FIG. 5, consider a horizontal plane of car body 2 in which antenna apparatus 1 having patch antenna 11 is mounted. The solid line shows the directional gain of antenna apparatus 1. In comparison with this, the dotted lines show directional gain of an antenna apparatus having a patch antenna having a waveguide with L-shaped slit 621. The antenna gain in antenna apparatus 1 achieves more circular directional gain than by an antenna apparatus having a patch antenna without L-shaped slit 621.

As described above, with the present embodiment, patch antenna 11 has waveguide 60 having spacer 61 and top plate 62 with L-shaped slit 621. By this means, it is possible to increase the directional gain of patch antenna 11 at a high elevation angle and make the direction gain at a given elevation angle uniform at all azimuth angles.

Also, antenna unit 12 has patch antenna 11. By this means, it is possible to provide antenna unit 12 that can increase the directional gain at a high elevation angle and make the directional gain at a given elevation angle uniform at all azimuth angles. Also, antenna apparatus 1 has antenna unit 12. By this means, it is possible to provide antenna apparatus 1 that can increase the directional gain at a high elevation angle and make the directional gain at a given elevation angle uniform at all azimuth angles.

The above description of the present embodiment has shown a patch antenna, an antenna unit and an antenna apparatus according to the present invention simply by way of example, and is by no means limiting.

Top plate 62 is a square flat plate with the present embodiment, but this is by no means limiting. For example, top plate 62 may also be an R-shaped flat plate.

Furthermore, with the present embodiment, patch antenna 11, antenna unit 12, antenna apparatus 1 presume a satellite radio receiving antenna, but this is by no means limiting. Patch antenna 11, antenna unit 12 and antenna apparatus 1 may be applied to other communication schemes or to resonant frequency radio communication.

Besides, the detailed configurations and detailed operations of antenna apparatus 1 according to the present embodiment can be changed or modified in various ways without departing from the scope of the present invention.

The invention claimed is:

1. A patch antenna comprising:

a patch antenna main body having an antenna electrode on a top surface thereof; and a waveguide mounted on the top surface of the patch antenna main body, wherein:

the waveguide comprises:

a top plate having a flat surface larger than the patch antenna main body and having an L-shaped slit in the flat surface: and a spacer provided between the top surface of the patch antenna main body and the top plate for separating the antenna electrode from the top plate by a predetermined distance.

2. An antenna unit comprising the patch antenna according to claim 1; a circuit board on which a signal processing circuit for processing a signal received by the patch antenna is formed; and a shield case for shielding the signal processing circuit.

3. An antenna apparatus comprising the antenna unit according to claim 2; a bottom plate; and a unit fixing member provided between the antenna unit and the bottom plate for fixing the antenna unit to the bottom plate.

* * * * *